US007264863B2

(12) United States Patent
Haymond

(10) Patent No.: US 7,264,863 B2
(45) Date of Patent: Sep. 4, 2007

(54) CABINET CORNER PROTECTOR

(75) Inventor: Bradley J. Haymond, Aurora, IL (US)

(73) Assignee: Illinois Tool Works Inc, Glenview, IL (US)

( * ) Notice: Subject to any disclaimer, the term of this patent is extended or adjusted under 35 U.S.C. 154(b) by 145 days.

(21) Appl. No.: 10/927,906

(22) Filed: Aug. 27, 2004

(65) Prior Publication Data

US 2005/0129908 A1 Jun. 16, 2005

Related U.S. Application Data

(60) Provisional application No. 60/529,066, filed on Dec. 12, 2003.

(51) Int. Cl.
*B65D 81/07* (2006.01)

(52) U.S. Cl. ..... 428/99; 428/119; 206/453; 206/586; 229/199; 248/345.1

(58) Field of Classification Search ..... 428/99, 428/119; 206/453, 586; 229/199; 248/345.1
See application file for complete search history.

(56) References Cited

U.S. PATENT DOCUMENTS

| | | | | |
|---|---|---|---|---|
| 4,779,751 | A * | 10/1988 | Munroe | 217/69 |
| 4,951,821 | A * | 8/1990 | Kempkes | 206/453 |
| 5,749,512 | A * | 5/1998 | Gingras-Taylor | 229/199 |
| 6,368,694 | B1 | 4/2002 | Marsh et al. | 428/99 |
| 2003/0052037 | A1 * | 3/2003 | Baechle | 206/586 |

* cited by examiner

*Primary Examiner*—Alexander S. Thomas
(74) *Attorney, Agent, or Firm*—Mark W. Croll; Paul F. Donovan

(57) ABSTRACT

A corner protector for cabinets, furniture and the like includes outside corner protecting panels joined at a corner edge and inside corner resilient members for holding the protector on the cabinet, with the resilient members spaced from the corner and having one or more points of contact with the furniture or cabinet on which the protector is installed.

14 Claims, 2 Drawing Sheets

CABINET CORNER PROTECTOR

CROSS-REFERENCE TO RELATED APPLICATIONS

The present regular United States patent application claims the benefit of U.S. Provisional Application Ser. No. 60/529,066 filed Dec. 12, 2003.

FIELD OF THE INVENTION

The present invention relates generally to cabinet corner protectors of the type used to protect end edge corners of cabinets, furniture and the like during shipment and handling.

BACKGROUND OF THE INVENTION

Cabinets, furniture and the like are often shipped long distances from the point of manufacture to the point of sale or installation. While steps are taken to protect the items during shipment, including packing the items in cardboard boxes or the like, damage can occur. For example, with kitchen or other installed cabinets, components are manufactured in a factory-type setting and shipped to the site of location. During shipment they may be moved several times at warehouses at either end of the shipment and also may be moved during shipment from one container or truck to another. Even after arriving at the site of installation, the components can be handled many times prior to installation. When damage occurs, long delays can result in obtaining a replacement part or component, which can delay final installation of the modular cabinetry. Repairs can be both time consuming and costly.

Even after shipping has been completed, damage can occur as components are being installed. For example, often it is necessary to move cabinets around the installation site, sometimes after the outer box has been removed. During shipping, handling and installation, one of the more vulnerable areas of a cabinet is the edge corner of the cabinet. The corner edge along the top or bottom edge forms a point that can be easily damaged as the cabinet is moved. Even minor sliding of the cabinet can cause damage.

Similar problems are experienced with stand-alone furniture, such as shelving units, bedroom furniture including bureaus, dressers and the like. Such pieces are handled many times between departure from the site of original manufacture and shipment to the final delivery at the location of the buyer. Repeated handling increases the opportunity for damage to occur.

Various protectors have been used in the past for corner edge protection. However, some have been difficult to install and have not stayed in proper position without the use of fasteners or the like. Using fasteners such as nails, staples or screws to attach a protector is undesirable. Even if the fastener is placed in an inconspicuous place, more visible areas can be damaged when the fastener is removed. Installing and removing fasteners is time-consuming. Self-fastening protectors in the form of a simple right-angle channel are known, but do not stay in position well and can not be used if a corner gusset or other strengthening piece is provided near the corner.

What is needed in the art is an edge corner protector that is easy to install quickly, stays in position during shipping and handling, is easy to remove when necessary, and that accommodates corner gussets and other frame and strengthening members in the corner of cabinets, furniture and the like.

SUMMARY OF THE INVENTION

The present invention provides a corner protector that has an outside protecting surface wrapping a corner edge of a cabinet or the like, and inside retention members spaced from the corner edge and having one or more points of contact with the cabinet.

In one aspect thereof, the present invention provides a corner protector for shielding end corner portions of an object having walls forming a corner. The protector has an outside corner protecting structure including first and second panels joined at an angle to form a corner edge, and an inside corner anchoring structure including first and second resilient arms in opposed relation to the first and second panels. The first and second resilient members are spaced from each other and from the corner edge. An interconnecting network forms one or more connections between the first and second panels and the first and second arms, and spans the walls of the object, with the panels on one side of the walls and the arms on an opposite side of the walls.

In another aspect thereof, the present invention provides a corner protector for cabinets and the like having walls forming a corner. The corner protector has first and second panels joined to each other to form an angle having a corner edge. The panels have end edges extending away from the corner edge. First and second legs extend inwardly relative to the corner and are connected to the first and second panels in spaced relation to the corner edge. First and second resilient arms are connected to the first and second legs respectively. Each arm is associated with a different one of the panels for receiving a cabinet wall therebetween.

In still another aspect thereof, the present invention provides a corner protector with an outside corner protection structure including first and second panels joined at a corner edge, and first and second arm structures associated with the first and second panels, respectively. Each arm structure is spaced from the corner edge along the respective one of the first and second panels with which it is associated to form a space for receiving an end edge of a wall on a structure to be protected. Each arm has one or more spaced points for contacting the structure.

An advantage of the present invention is providing a corner protector for cabinets and the like that can be installed quickly, stays in position throughout shipping and yet can be removed quickly and easily when desired.

Another advantage of the present invention is providing a corner protector that can be used on cabinets having cabinet panels of different widths.

Still another advantage of the present invention is providing a cabinet corner protector that can be installed and will stay in place on cabinets having corner gussets or frame members near the corner for strengthening the cabinet.

Other features and advantages of the invention will become apparent to those skilled in the art upon review of the following detailed description, claims and drawings in which like numerals are used to designate like features.

Figure 1:
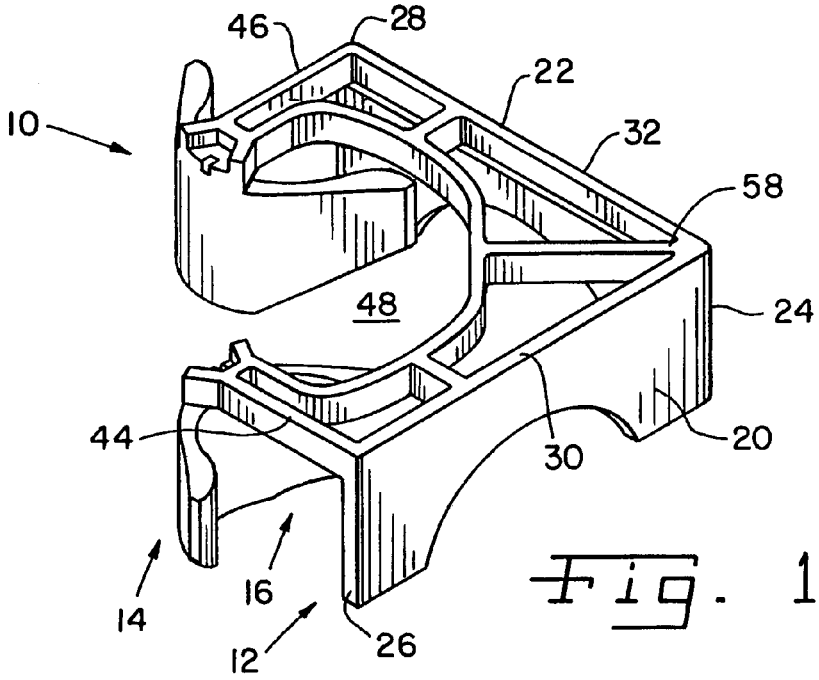
FIG. 1 is a perspective view of a cabinet corner protector in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings, and to FIG. 1 in particular, numeral 10 designates a cabinet corner protector in accordance with the present invention. Corner protector 10 can be made of plastic or other suitable materials and can be made in a variety of sizes for use on cabinets or furniture of different types. Protector 10 can be formed by molding or other suitable forming techniques and can be provided as a monolithic, one-piece structure.

Protector 10 includes an outside corner protecting structure 12, an inside corner anchoring structure 14 and an interconnecting network 16 joining outside corner protecting structure 12 with inside corner anchoring structure 14.

Outside corner protecting structure 12 includes first and second panels 20 and 22 forming a corner edge 24 where adjacent edges of panels 20 and 22 meet. Each panel extends away from corner edge 24, terminating at side edges 26 and 28, respectively. Each panel 20, 22 further includes an end edge 30, 32 extending between corner edge 24 and respective side edges 26 and 28. End edges 30 and 32 can be substantially planar, although in a preferred structure advantages for use on bottom edge corners of articles that may be slid along floors or surfaces, a slight chamfer or taper is provided in each end edge 30 and 32 adjacent corner edge 24. As those skilled in the art will understand readily that a suitable use for corner protector 10 is on the bottom edge corner of base cabinetry. Chamfering end edges 30 and 32 in the immediate area of corner edge 24 allows the cabinets to be slid along the floor or other surface without the corner edge catching on uneven floor surfaces or structures. Panels 20, 22 can be provided in different sizes appropriate for the particular items on which protector 10 is used. Thus, panels 20, 22 can be made longer or shorter, and wider or narrower by changing the lengths of edges 24, 26, 28, 30 and 32.

Inside corner anchoring structure 14 includes first and second anchoring arms 40, 42, respectively, generally connected to first and second panels 20 and 22 by connecting legs 44, 46. Legs 44, 46 are joined to panels 20, 22, some distance from corner edge 24 to provide a generally open area 48 inside of panels 20, 22 and generally between first and second arms 40, 42. In the exemplary embodiment of the present invention shown in the drawings, legs 44, 46 are connected to panels 20, 22 near side edges 26, 28, respectively.

Legs 44, 46 are part of interconnecting network 16 which further includes a curved brace member 50 between first and second arms 40, 42 and a plurality of cross-brace members 52, 54, 56 between curved brace 50 and first and second panels 20, 22. In the exemplary embodiment shown, one brace member 54 extends substantially between corner edge 24 and curved brace 50, substantially bisecting the angle formed by first and second panels 20, 22. Brace member 54 connected at corner edge 24 is slightly tapered near corner edge 24 for the same reasons as the slight chamfer or taper is provided in end edges 30, 32. A limited area 58 at the end of corner edge 24 is relieved from the plane on which protector 12 will rest on a surface, thereby allowing protector 10 to be slid across a surface with reduced opportunity for snagging.

First and second arms 40, 42 each provide multiple points of contact with a cabinet on which protector 10 is installed. Accordingly, in the exemplary embodiment shown in the drawings, first arm 40 includes arm segments 60 and 62, and second arm 42 includes arm segments 64 and 66. Each arm segment 60, 62, 64 and 66 curves away from the respective anchoring leg 44, 46 to which it is attached and toward the one of panels 20, 22 with which it is associated. Each arm segment 60, 62, 64, 66 has a distal end generally confronting and engaged against a wall or the like received between the arm segment 60, 62, 64 66 and its associated panel 20, 22.

Figure 2:
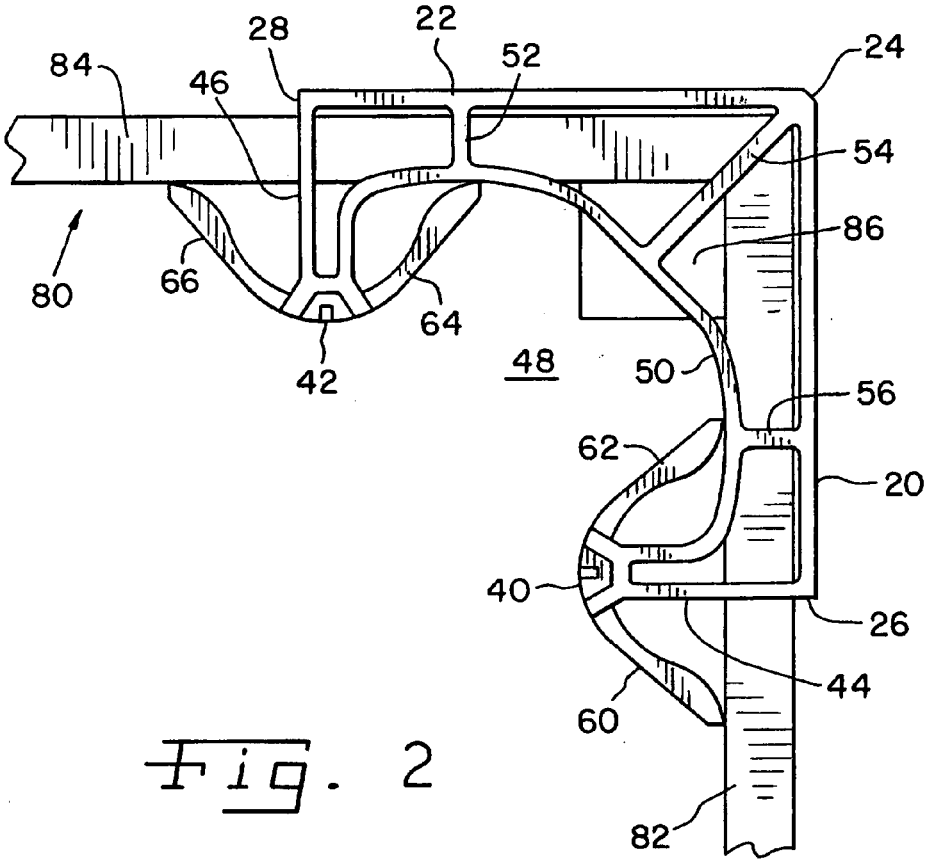
FIG. 2 is a top view of the cabinet corner protector shown in FIG. 1, illustrating installation of the protector on a cabinet.

With reference now to FIG. 2, it can be seen how corner protector 10 is installed on a cabinet 80 having first and second cabinet walls 82 and 84 forming a corner of the cabinet. Protector 10 is slid over end edges of walls 82 and 84 and pressed in place to align with the cabinet corner edge formed by walls 82 and 84. Arm segments 60, 62, 64 and 66 spring, flex or bend as necessary to accommodate walls 82, 84 of different thickness. Interconnecting network 16 extends across end edges of walls 82 and 84 and provides structure on which cabinet 80 can rest, with walls 82, 84 spaced from the supporting surface and thereby protected. Corner protecting structure 12 is disposed along the outside surfaces of cabinet walls 82, 84, wrapping the corner edge of cabinet 80 formed by cabinet walls 82, 84. Edges of cabinet 80 most vulnerable to damage are covered and shielded by protector 10. Inside corner anchoring structure 14 is disposed against the inside surfaces of walls 82 and 84. The substantially open area 48 defined by corner protector 10 allows for and accommodates gussets 86 or other frame structure that may be used to strengthen cabinet 80 and particularly walls 82 and 84 at the corner of the cabinet. With multiple points of contact, protector 10 stays in place with normal handling of the cabinet, even without the use of fasteners or the like. Protector 10 can be removed easily by simply pulling it from the end edges of cabinet walls 82, 84.

Figure 3:
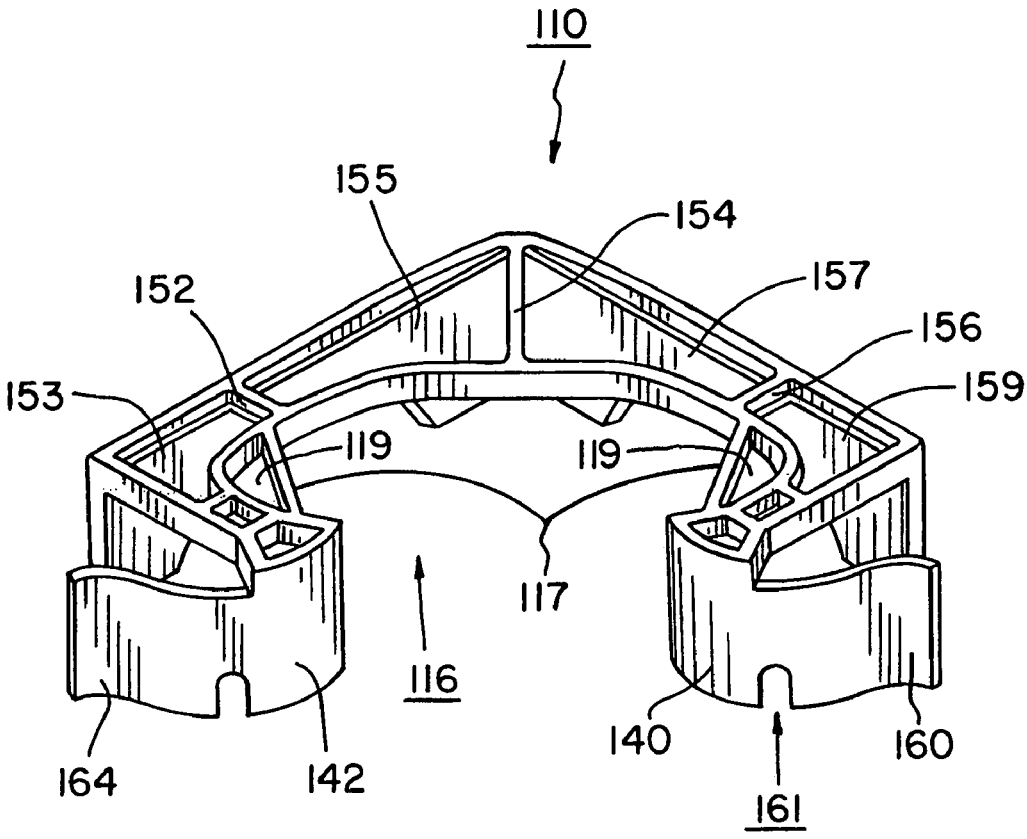
FIG. 3 is a perspective view of an alternative cabinet corner protector is accordance with the present invention.

With reference to FIG. 3, an alternative protector 110 is provided. The protector 110 is similar to protector 10 with the exception of a few structural differences. First, as shown in FIGS. 1 and 2, the interconnecting network 16 of protector 10 includes open spaces between cross-brace members 52, 54 and 56. The protector 110 does not include open spaces between cross-brace members 152, 154 and 156. Rather, the spaces include solid wall members 153, 155, 157 and 159. In addition, the interconnecting network 116 includes further brace members 117, and solid wall members 119. Second, the anchoring arms 40 and 42 of protector 10 include arm segments 60 and 62, and arm segments 64 and 66, respectively. The protector 110 includes arm segments 140 and 142, but only one arm segment 160, and arm segment 164, respectively. Third, each arm segment 160 and 164 includes a relief notch 161 to provide additional flexibility when installing the protector on a cabinet.

Thus, the present invention provides a corner protector that is inexpensive, easy to install, versatile, secure and easy to remove.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A corner protector for shielding end corner portions of an object having walls forming a corner, said protector comprising:

an outside corner protecting structure including first and second panels joined at an angle to form a corner edge;

an inside corner anchoring structure including first and second resilient arms in opposed relation to said first and second panels, said first and second resilient arms being spaced from each other and from said corner edge; and an interconnecting network forming multiple connections between said first and second panels and said first and second arms, and being adapted to span the walls of the object, with said panels being configured to be placed on one side of the walls and said arms being configured to be placed on an opposite side of the walls so as to capture the object between said panels and said arms;

wherein said first and second arms each having multiple spaced segments for contacting the walls of the object.

2. The corner protector of claim 1, said first and second arms each including two arm segments having spaced distal ends for contacting the walls of the object.

3. A corner protector for shielding end corner portions of an object having walls forming a corner, said protector comprising:

an outside corner protecting structure including first and second panels joined at an angle to form a corner edge;

an inside corner anchoring structure including first and second resilient arms in opposed relation to said first ad second panels, said first and second resilient arms being spaced from each other and from said corner edge; and an interconnecting network forming multiple connections bctween said first and second panels and said first and second arms, and being adapted to span the walls of the object, with said panels being configured to be placed on one side of the walls and said arms being configured to be placed on an opposite side of the walls so as to capture the object between said panels and said arms;

wherein said interconnecting network including a curved brace between said arms, and plurlity of bars between said curved brace and said panels.

4. The corner protector of claim 3, each said arm having two curved arm segments with spaced distal ends for contacting the walls of the object.

5. A center protector for an object having walls forming a corner, said corner protector comprising:

first and second panels joined to each other to form a angle having a corner edge, said panels having end edges extending away from said corner edge;

first and second legs extending inwardly relative to said corner edge, said first and second legs being connected to said first and second panels in spaced relation to said corner edge; and first and second resilient arms connected to said first and second legs respectively, each said arm associated with a different one of said panels, said arms and said panels being configured to receive a respective wall of the object therebetween, such that each wall of the object is spanned by said associated first and second legs when the object is positioned and captured between said first and second panels and said first and second resilient arms wherein each said first and said second resilient arms include at least one curved arm segment having a distal end in spaced, opposed relation to said first and second panels.

6. The corner protector of claim 5, including a curved brace interconnecting said first and second panels.

7. The corner protector of claim 6, each said first and said second resilient arm including two curved arm segments having distal ends in spaced, opposed relation to said first and second panels.

8. The corner protector of claim 7, including a plurality of individual cross traces extending between said curved trace mid said first mid second panels.

9. The corner protector of claim 8, said end edges being substantially planar.

10. The corner protector of claim 8, one said brace substantially bisecting the angle formed by said panels.

11. The corner protector of claim 10, said one said brace and said end edges of said panels be tapered near said corner edge.

12. A corner protector comprising:

outside corner protection structure including first and second panels joined at a corner edge;

first and second arm structures asociated with said first and second panels, respectively, each said structure spaced from said corner edge along the respective one of said first and second panel with which it is associated to form an opening between an end of said arm structure and said respective first and second panels for receiving an end edge of a wall on a structure to be protected, each said end of said arm configured for contacting the structure;

first and second legs between edge of said first and second panels and said first and second arms, respectively;

a curved brace between said first and second arms; and a plurality of cross braces between said curved brace and said first and second panels;

wherein said first and second legs and said plurality of cross braces are configured to span the end edge of the wall on the structure received in said opening between said end of said arm structure and said respective first and second panels when the structure is captured between the respective first and second panels and first and second arm structures;

wherein said first and second arms each have multiple spaced segments for contacting walls of the structure.

13. The corner protector of claim 12, an end of said corner edge being chamfered.

14. The corner protector of claim 12, wherein said first and second arms each include two arm segments having spaced distal ends for contacting the walls of the structure.

* * * * *

UNITED STATES PATENT AND TRADEMARK OFFICE

CERTIFICATE OF CORRECTION

PATENT NO. : 7,264,863 B2
APPLICATION NO. : 10/927906
DATED : September 4, 2007
INVENTOR(S) : Haymond It is certified that error appears in the above-identified patent and that said Letters Patent is hereby corrected as shown below:

In Column 5, Line 41, in Claim 3, delete “ad” and insert -- and --, therefor.

In Column 5, Line 57, in Claim 5, delete “center” and insert -- corner --, therefor.

In Column 6, Line 15, in Claim 6, delete “panels.” and insert -- arms. --, therefor.

In Column 6, Line 22, in Claim 8, delete “traces” and insert -- braces --, therefor.

In Column 6, Line 22, in Claim 8, delete “trace” and insert -- brace --, therefor.

In Column 6, Line 23, in Claim 8, delete “mid” and insert -- and --, therefor.

In Column 6, Line 23, in Claim 8, after “first” delete “mid” and insert -- and --, therefor.

In Column 6, Line 35, in Claim 12, after “said” insert -- arm --.

Signed and Sealed this

Twenty-ninth Day of April, 2008

JON W. DUDAS
*Director of the United States Patent and Trademark Office*